United States Patent [19]

Pahl

[11] 3,938,843

[45] Feb. 17, 1976

[54] SNOW CRADLE

[76] Inventor: Otto Andrew Pahl, 36 Worden Road, Scotia, N.Y. 12302

[22] Filed: June 26, 1974

[21] Appl. No.: 477,489

[52] U.S. Cl. ..... 294/54; 37/53; 294/58

[51] Int. Cl.[2] ..... E01H 5/02

[58] Field of Search ..... 294/49, 54, 57, 58, 59; 30/309, 312, 318; 37/53; 224/5 B; 254/131.5

[56] References Cited

UNITED STATES PATENTS

| | | | |
|---|---|---|---|
| 827,791 | 8/1906 | Durkee | 30/312 X |
| 2,521,441 | 9/1950 | Bickley | 294/54 X |
| 2,826,835 | 3/1958 | O'Shea | 294/58 X |
| 3,082,554 | 3/1963 | Steeb | 294/58 X |

FOREIGN PATENTS OR APPLICATIONS

| | | | |
|---|---|---|---|
| 24,108 | 2/1922 | France | 294/59 |

*Primary Examiner*—Evon C. Blunk
*Assistant Examiner*—Johnny D. Cherry

[57] ABSTRACT

A manual snow moving tool made entirely of soft wood, with the exception of bolts used as fastenings, comprising a concaved curved faced scoop or blade, with the two longer ends of the long handles fastened on the convex back of the scoop, spacing the upper end of the handles apart the required distance, so a body may easily stand between them, and the cross arm fastened about two thirds of the distance from the top of the scoop, the three extreme handles facing the operator having a long flat chamfered handles.

1 Claim, 3 Drawing Figures

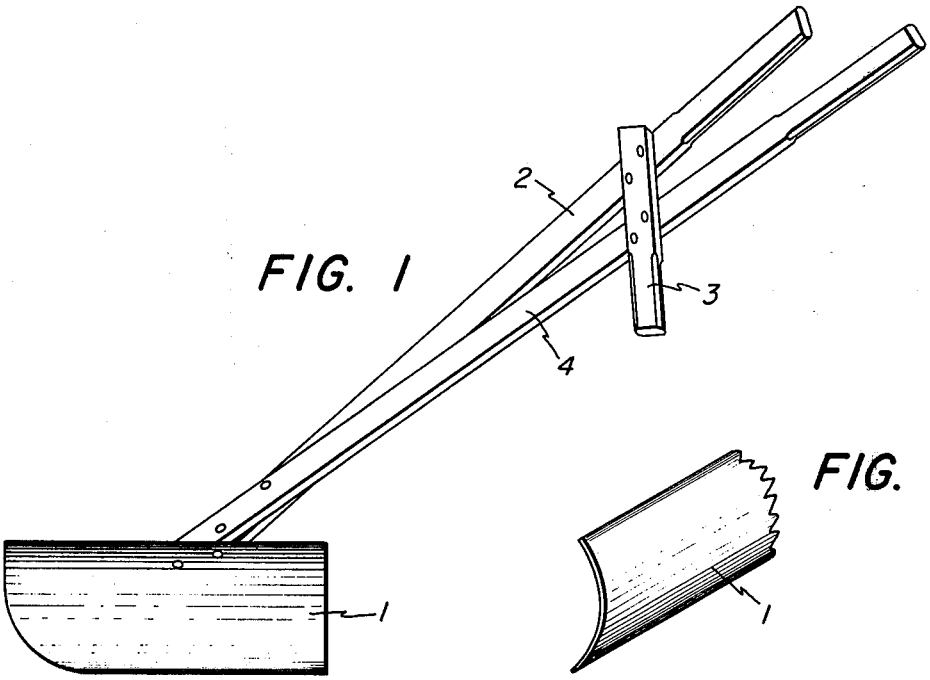
FIG. 1
FIG. 2
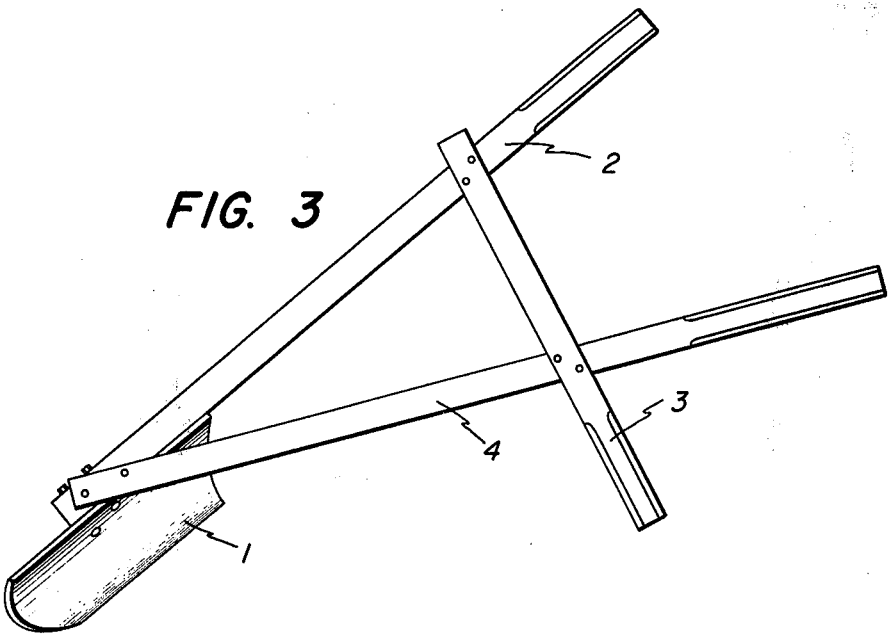
FIG. 3

SNOW CRADLE

DRAWINGS AND DESCRIPTIONS.

On which,

FIG. 1, Is a perspective view of the Snow Cradle in the normal position the operator would be using this tool.

FIG. 2, Shows the end section of the concave and the convex shape of the scoop and the lower cutting blade.

FIG. 3. Shows in plan, Clearly, the scoop and all the handles in their proper placement bolted together, ready as a tool to do the required work it was designed for moving snow.

The parts of the manually operated snow cradle on the drawings in FIG. 1 show the position which they would occupy in the hands of the user. The scoop of the snow mover is indicated at 1 and is in the form of a concaved, curved, rectangular, laminated, veneered wood, hot resin bonded, with a curved cut on the leading lower edge which cuts and enters the snow. A soft wood arm 2, rectangular in cross section, has at the lower end a twisted cut on the edge and is fastened to the back of the convex scoop 1 at a given angle. The other end of this arm contains a long chamfered flat handle. A second longer wood arm 4 rectangular in cross section has its lower end fastened on the top of arm 2 near the top edge of the scoop and has an extra long chamfered handle. A short rectangular section wood arm 3 is secured across the top of the spread-apart arms 2 and 4 with a long chamfered handle end extending over the top of arm 4. FIG. 3 clearly shows the parts in their rightful positions.

I claim:

1. A manually operated snow mover comprising a curved wooden scoop, a pair of spaced handle arms fastened to the convex back of the scoop, a lower cutting edge and a leading circular cutting toe on the scoop, the free ends of the arms being spaced apart so the longer flat arm may be placed under a user's arm pit to act as a lever, the other arm having a long handle portion to form one half of a fulcrum and a cross arm with a handle portion connected across the two arms and extending over a considerable distance to be grasped by a user's hand to form the other half of the fulcrum whereby the fulcrum has a circular motion acting as a movable imaginary pivot, the center of this pivot floating up and down and side to side as the snow mover is used in a sweeping motion.

* * * * *